US007854528B2

(12) United States Patent
Segretto et al.

(10) Patent No.: US 7,854,528 B2
(45) Date of Patent: Dec. 21, 2010

(54) ILLUMINATION APPARATUS FOR BAG TOSS GAME

(76) Inventors: Perry J. Segretto, 370 N. Oaklawn Ave., Elmhurst, IL (US) 60126; Michael Koczor, 3N370N Wilson, Elmhurst, IL (US) 60126

( * ) Notice: Subject to any disclaimer, the term of this patent is extended or adjusted under 35 U.S.C. 154(b) by 314 days.

(21) Appl. No.: 12/284,794

(22) Filed: Sep. 25, 2008

(65) Prior Publication Data

US 2009/0091926 A1 Apr. 9, 2009

Related U.S. Application Data

(60) Provisional application No. 60/975,267, filed on Sep. 26, 2007.

(51) Int. Cl.
*F21L 4/02* (2006.01)
*A63B 63/00* (2006.01)

(52) U.S. Cl. ..... 362/191; 362/249.05; 362/249.06; 273/402

(58) Field of Classification Search ..... 362/121, 362/154, 191, 230, 231, 247, 249.02, 249.05, 362/249.06, 249.17, 259, 296.01, 307, 311.02; 273/348, 402

See application file for complete search history.

(56) References Cited

U.S. PATENT DOCUMENTS

| | | | | |
|---|---|---|---|---|
| 4,923,201 | A * | 5/1990 | Nichol et al. | 273/402 |
| 4,927,160 | A * | 5/1990 | Nichol et al. | 273/402 |
| 2007/0049425 | A1* | 3/2007 | Butler | 473/415 |
| 2008/0116644 | A1* | 5/2008 | Knoernschild | 273/402 |
| 2010/0164175 | A1* | 7/2010 | Buchanan | 273/402 |

* cited by examiner

*Primary Examiner*—David V Bruce
(74) *Attorney, Agent, or Firm*—Nicholas A. Camasto

(57) ABSTRACT

A light array for illuminating the circular opening in the platform of a bag toss game includes a circular frame and mating cover that define a hole, at least equal in area to the opening. A plurality of lights (LEDs) is positioned in the annular enclosure formed by the frame and cover. The cover includes a transparent wall through which light is projected to the opening in the platform. An annular printed circuit board is supported in the annular enclosure and mechanically supports and electrically connects the LEDs to a switched battery source. Different embodiments for blinking and sequencing the LEDs are shown. A laser diode arrangement for producing a cross hair pattern of beams in the platform hole is also described.

18 Claims, 2 Drawing Sheets

ILLUMINATION APPARATUS FOR BAG TOSS GAME

CROSS REFERENCE TO RELATED APPLICATION

This application claims the benefit of the inventors' Provisional Application No. 60/975,267, filed Sep. 26, 2007.

BACKGROUND OF THE INVENTION AND PRIOR ART

This invention relates generally to so called bag toss games and in particular to bag toss games that are played under conditions of low ambient light. A very old bag toss game is Cornhole, also called Corn Toss, which has recently become quite popular. In the game, which is very similar to horseshoes, players take turns pitching small bags, filled with corn, sand or beans, at a raised platform having a six inch diameter hole, centered nine inches from the far end of the platform. The bags are sized for entry into the holes. The platforms, which are often decorated, are made of rigid plywood or plastic. Different scores are provided for bags tossed, or knocked, into the hole or that land on the board. Generally a corn bag in the hole counts for three points, while one on the platform scores one point. Play continues until one player reaches a score of 21. Regulation-size platforms are four feet by two feet, with the back end raised one foot and the front end about two to four inches above the ground. The two platforms are spaced about 40 feet apart, similar to the stakes in horseshoes. Additionally, there should be 12 feet of vertical clearance above the playing area. As such, the cornhole game is designed for outdoor play. As in horseshoes, players may be grouped into teams or matched individually.

Being an outdoor game, cornhole is generally intended to be played during daylight hours. However, since it is an excellent outdoor party game, it is often played during the evening where the lighting may not be optimal. Providing sufficient lighting for evening play may not only be inconvenient, but undesirable since it may detract from the ambiance desired at an outdoor party.

Accordingly, the present invention is directed toward enabling bag toss games to be played under conditions of low ambient light, without affecting the surrounding ambiance.

OBJECTS OF THE INVENTION

The principal object of the invention is to provide an improved bag toss game.

Another object of the invention is to provide a light array for illuminating the opening in the platform of a bag toss game.

A further object of the invention is to provide an LED light array for illuminating the opening in the platform of a bag toss game without significantly affecting the ambiance of the surrounding area.

A feature of the invention is the provision of electronic means for establishing different patterns of illumination for the invention.

Another feature of the invention resides in the provision of an annular printed circuit board for mechanically supporting, and electrically connecting, the LEDs in the light array.

Still another feature of the invention resides in the provision of laser diodes for establishing a crosshair pattern in the opening in the platform of a bag toss game.

BRIEF DESCRIPTION OF THE DRAWINGS

These and other objects and advantages of the invention will become apparent upon reading the following description in conjunction with the drawings, in which.

SUMMARY OF THE INVENTION

In accordance with the invention, a light array is provided for enhancing the visibility of the opening in the platform of a bag toss game, such as Cornhole. The light array includes a frame and a nesting cover defining a hole, equal to or larger than the opening in the platform, having a plurality of lights positioned thereabout for illuminating the hole through a transparent wall of the cover. The frame is secured to the platform with the hole defined by the frame and the cover in alignment with the opening in the platform.

DESCRIPTION OF THE PREFERRED EMBODIMENT

Figure 1:
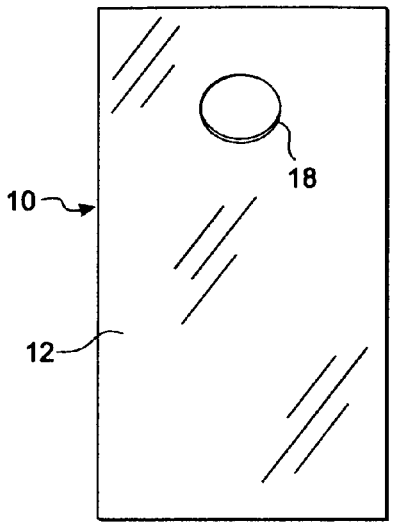
FIG. 1 is plan view of a Cornhole bag toss game.
Figure 2:
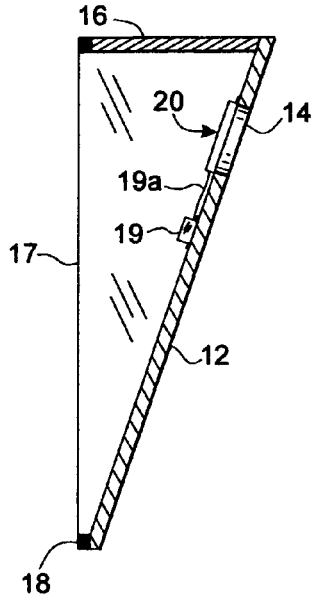
FIG. 2 is a side sectional view of FIG. 1 showing the invention.

Referring to FIGS. 1 and 2, a Cornhole bag toss game 10 includes a rectangular platform 12 having a circular opening 14 near its elevated distal end. As mentioned, the platform may be constructed of wood or plastic and measures about four feet by two feet. A rear riser 16 elevates the distal end of platform 12 by about one foot, whereas a rear riser 18 provides a much smaller elevation, on the order of two to four inches at the proximal, or front end of the platform. It will be appreciated that in practice two of the platforms are disposed with their proximal ends about 40 feet apart. It should be noted that, in place of risers 16 and 18, legs may be provided. The legs may be removable to facilitate storage of the Cornhole game. In FIG. 2, the illumination apparatus 20 of the invention is seen to be secured to the underside of platform 12, along with its power supply 19. Optional sides may be used with the platform, such as the one indicated by reference numeral 17.

Figure 3:
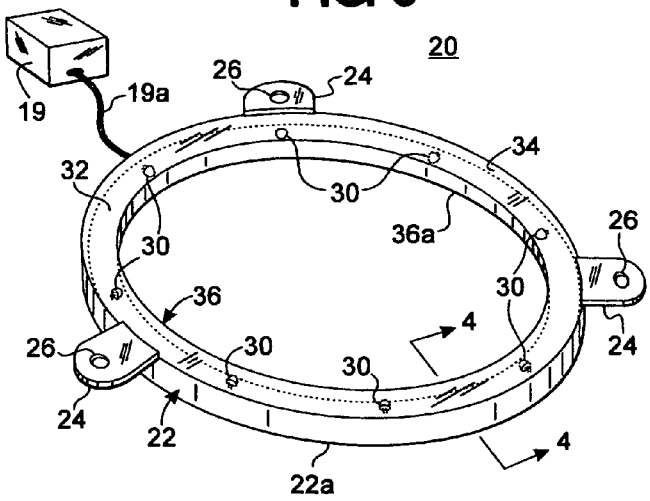
FIG. 3 is a perspective view of the underside of the preferred form of the light array of the invention.
Figure 4:
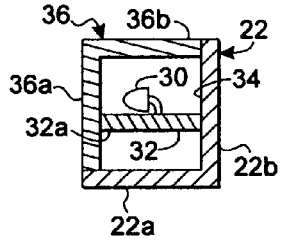
FIG. 4 is a cross section taken along line 4-4 of FIG. 3.
Figure 5:
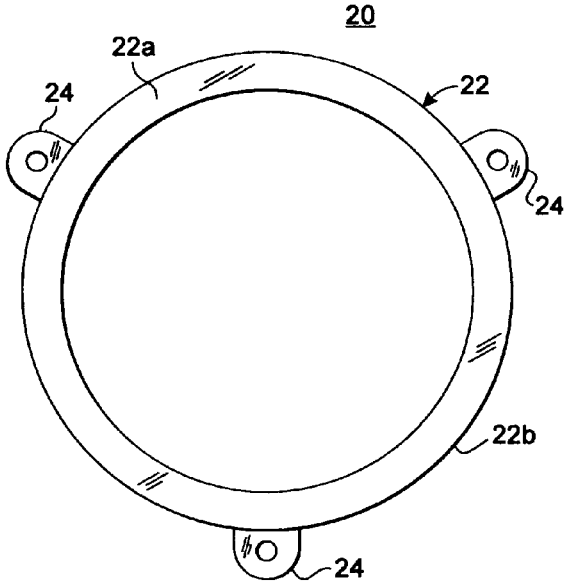
FIGS. 5-8 are views of the various components of the present invention.

FIG. 3 is an underside perspective view of the light array 20 of the invention. Reference may be advantageously be made to the cross section of FIG. 4 and to the views of FIGS. 5-8 in understanding its construction. A circular frame 22 includes a bottom wall 22*a* and an upstanding outer wall 22*b* (FIG. 5). Frame 22 may be molded of plastic and includes three spaced mounting ears 24, each having a screw-receiving aperture 26 therein. A circular cover 36 includes an inner wall 36*a* and a top wall 36*b* at right angles thereto (FIG. 8). Cover 36 is transparent and is also preferably made of molded plastic. The parts are configured such that cover 36 and frame 22 nest to form an annular enclosure having a substantially square cross section. An annular printed circuit board 32 supports a plurality of inwardly directed LEDs (light-emitting-diodes) 30 that are disposed such that their light is directed through inner wall 36*a*. The leads of LEDs 30 mechanically secure and electrically connect the LEDs to circuit board 32 (FIG. 7). Resistors 44 are positioned and connected to the underside of circuit board 32. A switched power supply 19 is connected via a pair of leads 19*a* to circuit board 32. The inner surface of outer wall 22*b* is preferably light reflective to enhance the light emitted by the LEDs. The reflective surface may take the form of suitable plating or, as in the preferred embodiment, a reflective foil tape 34 that is secured to the inner surface of outer wall 22*b*.

Figure 6:
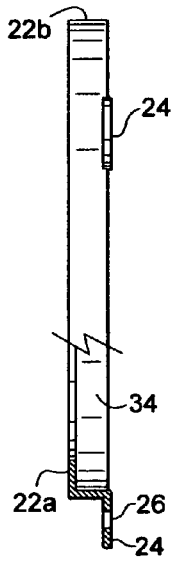
Figure 7:
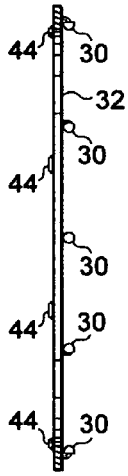
Figure 8:
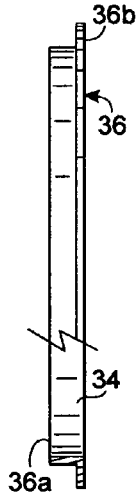

The depictions of FIGS. 5-8 illustrate the interrelationship of the elements of the invention, as discussed above. FIG. 5 is a view of the light array as seen from the rear of platform 12. FIG. 6 is a partially cut away side elevation of frame 12 of FIG. 5 illustrating its construction. FIG. 8 is a displaced partially cut away side elevation of cover 36 that illustrates, in conjunction with FIG. 4, the nesting relationship the frame and cover. Circuit board 32 is positioned in the area between frame 12 and cover 36 and may be secured therein by one or more dabs of silicone cement 32*a* at various points as illustrated in FIG. 4. The mounting ears 24 may be used with appropriate mounting screws (not shown) to secure the light array to the back of platform 12. For a platform 12 that is constructed of plastic, other suitable well-known means, such as glue, double-sided tape, Velcro, etc. may be used to secure the light array.

Figure 9:
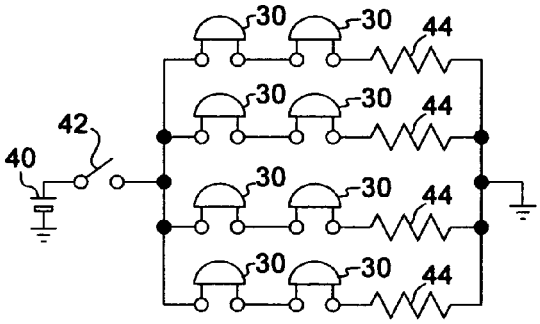
FIG. 9 is a schematic diagram of the LED circuits of the preferred embodiment of the invention.

FIG. 9 illustrates the simple schematic diagram of the preferred embodiment of the invention in which the switched power supply 19 comprises a conventional 9 volt battery 40 and a switch 42. The arrangement supplies four series circuits of two LEDs 30 and a resistor 44, connected in parallel.

Figure 10:
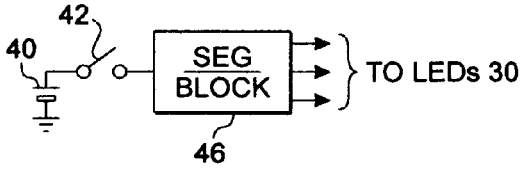
FIG. 10 is a block diagram of aspects of the invention that provide different operational sequencing of the LEDs.

FIG. 10 illustrates an arrangement including a block 46, labeled SEQ/BLINK, that contains circuitry whereby the LEDs may be either alternated in their ON and OFF states so as to operate sequentially or to simultaneously blink to enhance the illumination effect of the invention. The circuitry in block 46 is well-known in the art.

Figure 11:
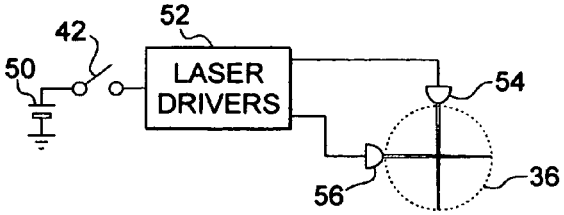
FIG. 11 illustrates an arrangement for using laser diodes to develop a cross hair pattern in the platform opening.

FIG. 11 illustrates a version of the invention for generating a crosshair pattern of low voltage laser beams in the hole of the light array of the invention. A suitable battery 50 is connected through switch 42 to a block 52, labeled Laser Drivers for supplying power to a laser diode 54 and a laser diode 56 which are appropriately positioned at right angles behind cover 36 of the light array. Here again such laser drivers are well known in the art.

What has been described is a novel light array for illuminating the opening in the platform of a Cornhole bag toss game. It is recognized that numerous changes in the described embodiments of the invention will be apparent to those skilled in the art without departing from its true spirit and scope. The invention is to be limited only as defined in the claims.

The invention claimed is:

1. For use with a bag toss game having a platform including an opening sized to permit passage of thrown bags having a proper trajectory and interference with thrown bags of improper trajectory:

a light array for illuminating said opening comprising:

a frame defining a hole similar in shape, but equal to or larger than, said opening;

one or more lights positioned about said frame for visually enhancing said opening;

power supply means for supplying energy to said one or more lights; and said light array being secured to said platform with said hole in alignment with said opening in said frame.

2. The light array of claim 1, wherein said opening is circular, and wherein;

said frame being circular and being secured to said platform;

said one or more lights comprise LEDs positioned about said frame, with the light from said LEDs being directed toward said hole; and said power supply means comprises a switch and a battery for energizing said LEDs.

3. The light array of claim 2, further including a mating cover for said frame, said mating cover having an inner transparent wall for passing light from said LEDs.

4. The light array of claim 3, wherein said frame includes an outer wall having a reflective surface for enhancing light transfer through said inner transparent wall.

5. The light array of claim 4, wherein some of said LEDs emit light of a different color than others of said LEDs.

6. The light array of claim 5, further including mounting ears about said frame for securing said frame and said cover to said platform.

7. The light array of claim 3, wherein said frame further includes a bottom wall and said cover further includes a top wall, said frame and said cover defining an annular enclosure for said LEDs, and further including:

an annular printed circuit board in said annular enclosure mechanically supporting said LEDs and making electrical connections between said LEDs and said power supply means.

8. The light array of claim 7, further including:

electronic circuitry connected between said switch and said LEDs for establishing operating patterns for said LEDs.

9. The light array of claim 8, wherein one of said operating patterns comprises operating said LEDs in sequence.

10. The light array of claim 8, wherein one of said operating patterns comprises alternating said LEDs between ON and OFF states.

11. The light array of claim 7, wherein said LEDs comprise a pair of laser diodes generating laser beams that intersect at right for establishing a crosshair laser beam pattern in said opening; and laser drivers for energizing said laser diodes.

12. For use with a bag toss game having a platform including a circular opening sized to permit passage of thrown bags having a proper trajectory and interference with thrown bags of improper trajectory:

a light array including one or more LEDs for illuminating said opening comprising:

a circular frame defining a circular hole equal to or larger than said opening;

said frame having a bottom wall and an outer wall;

a cover having a top wall and a transparent inner wall, for passing light from said LEDs;

said frame and said cover nesting to form an annular enclosure;

said LEDs being supported within said annular enclosure;

a switched battery for supplying energy to said LEDs; and mounting means for securing said frame to said platform with said hole in said frame in alignment with said opening in said platform.

13. The light array of claim 12, further including a reflective surface on said outer wall to enhance light transfer through said inner wall.

14. The light array of claim 13, further including an annular printed circuit board in said annular enclosure mechanically supporting said LEDs and making electrical connections between said LEDs and said switched battery.

15. The light array of claim 14, further including:

electronic circuitry connected between said switched battery and said LEDs for establishing operating patterns for said LEDs.

16. The light array of claim 15, wherein one of said operating patterns comprises operating said LEDs in sequence.

17. The light array of claim 15, wherein one of said operating patterns comprises alternating said LEDs between ON and OFF states.

18. The light array of claim 14, wherein said LEDs comprise a pair of laser diodes generating laser beams that intersect at right for establishing a crosshair laser beam pattern in said opening; and laser drivers for energizing said laser diodes.

* * * * *